US006113074A

United States Patent [19]

Foley

[11] Patent Number: 6,113,074

[45] Date of Patent: Sep. 5, 2000

[54] MULTI-PURPOSE CONSTRUCTION TOOL

[76] Inventor: John Patrick Foley, 5111 N. 10th Pl. #4, Phoenix, Ariz. 85014

[21] Appl. No.: 09/097,357

[22] Filed: Jun. 15, 1998

Related U.S. Application Data

[60] Provisional application No. 60/049,897, Jun. 17, 1997.

[51] Int. Cl.[7] ..... B66F 15/00

[52] U.S. Cl. ..... 254/25; 254/131.5

[58] Field of Search ..... 294/57; 16/110 R; 254/25, 131, 131.5; 81/4.5

[56] References Cited

U.S. PATENT DOCUMENTS

| | | | |
|---|---|---|---|
| 407,371 | 7/1889 | Rosenberger | 254/25 |
| 1,054,591 | 2/1913 | Michels et al. | 294/57 |
| 2,896,910 | 7/1959 | Cooper et al. | 254/25 |
| 3,987,827 | 10/1976 | Mills | 254/25 |
| 4,663,995 | 5/1987 | Amundson et al. | 254/131.5 |

*Primary Examiner*—Robert C. Watson
*Attorney, Agent, or Firm*—Gregrory J. Nelson

[57] ABSTRACT

A combination construction and wrecking tool for performing multiple operations such as hammering, picking, axing, pounding, prying and bashing. The tool has a shaft with a handle at the upper end which has a grip that is offset and which is rotatable. The head end has a slightly curved base with a notch at one end and a hammer face at the opposite end.

6 Claims, 2 Drawing Sheets

MULTI-PURPOSE CONSTRUCTION TOOL

This application is based on Provisional Patent Application Ser. No. 60/049,897, filed Jun. 17, 1997, entitled "Multipurpose Construction Tool".

FIELD OF THE INVENTION

The present invention relates to a construction tool and more particularly relates to a manual combination tool for performing multiple operations such as prying, hammering, chopping, fastener removal and similar operations often required in construction and demolition work.

BACKGROUND OF THE INVENTION

There are various multi-purpose or combination tools that can be found in the prior art. For example, U.S. Pat. No. 4,785,488 shows a lever bar for performing multiple operations which may be used as a crow bar, pry bar, sledge hammer, pick ax, wedge and the like. The lever bar has a long handle with a thick base chamfered at one end and secured perpendicular to the axis of the handle at the other. A foot plate has a sharp end for prying. An anvil plate is secured to the base plate and handle. The base plate and anvil can serve as hammer heads when the tool is used as a hammer. The base plate and foot plate can serve as a splitting wedge and as heads of a pick ax.

U.S. Pat. No. 3,921,288 shows a wrecking tool for piercing wall and ceiling surfaces for easy removal of sections. The tool can be used to perform a number of functions including chipping, piercing, prying, gouging, and tearing and can also be used as a lever for removing trim and for forcing doors and windows open.

Another combination tool is shown in U.S. Pat. No. 3,710,407. In this patent, the device is shown intended for use to open wrecked vehicles and has first and second ends with a bore extending therein. A second tool is selectively slidably received in the bore in the first tool member and has a head portion. The head portion includes a pry bar, cutting means and spike means mounted thereon. The first tool member is slidable and movable with respect to the second to effectively extend the length of the tool for leverage. The first tool member includes a hammer head at one end which may be used to strike the tool head when the tool members are separated to create additional impact force.

Thus, the prior art discloses a number of multi-purpose or combination tools for construction, wrecking and also for emergency use for personnel such as firemen and paramedics. Nevertheless there exists a need for a simple, efficient, reliable and sturdy tool which is a multi-purpose tool for construction and demolition work which will efficiently and effectively provide multiple functions.

BRIEF SUMMARY OF THE INVENTION

Briefly, the present invention provides an improved, versatile, multi-purpose construction and demolition tool which includes, in combination, a lever bar and hammer that may be used as a crow bar, pry bar, sledge hammer, pick ax, wedge, basher or the like. The combination lever bar and hammer has an elongated shaft which, in the preferred embodiment, has a transversely extending rotating handle which is offset with respect to the shaft. The opposite end of the shaft is connected to a head which is slightly curved or arcuate and is notched at one end so that it may be used as a pry bar and for removing fasteners such as nails. The opposite end of the head is turned up having a face disposed generally at 90° with respect to the base of the head to form a hammer head. The device is constructed of a sturdy material such as 4140 steel and may be forged or of welded construction.

BRIEF DESCRIPTION OF THE DRAWINGS

The above and other objects and advantages of the present invention will be more fully appreciated and understood from the following description, claim and drawings in which:

Figure 7A:
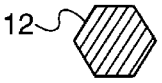
FIGS. 7A to 7C are cross-sectional views illustrating various configurations for the shaft.
Figure 7B:
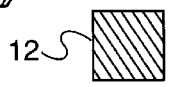
Figure 7C:
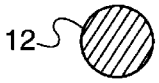

Turning now to the drawings, particularly FIGS. 1 to 6, the tool of the present invention is generally designated by the numeral 10 and as described is a multi-purpose tool for performing various construction and demolition operations. The tool 10 has an elongate shaft 12. The shaft 12 is shown as having a polygonal shape but as indicated in FIG. 7A, the shaft may be of any conventional cross-sectional shape such as square as shown in FIG. 7B or round as shown in FIG. 7C. Similarly, the shaft 12 may be of any suitable length. For some applications, it is preferred the shaft be only about 18" in length and for other applications the tool may be provided with a longer shaft up to 36" in length.

Figure 5:
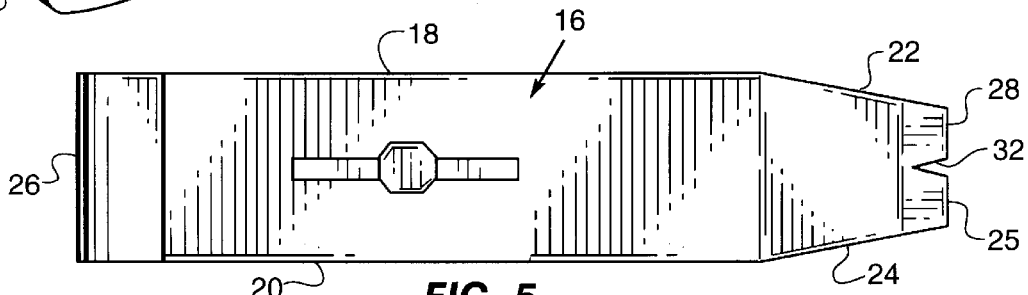
FIG. 5 is a sectional view taken along line 5—5 of FIG. 1.
Figure 6:
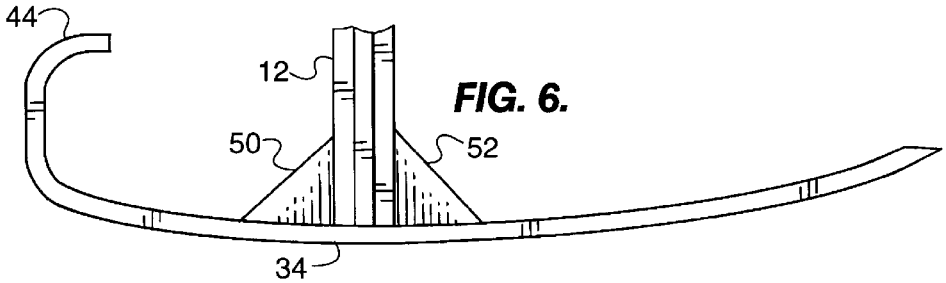
FIG. 6 is a side elevational view of the head and a portion of the shaft of the tool shown in FIG. 1.

The lower or distal end of the tool supports a head 16 which is also fabricated from a suitable high strength material such as 4140 steel. The head 16 has opposite side edges 18 and 20 and opposite ends 26 and 28. Side edges 18 and 20 are generally parallel although they converge slightly inwardly at 22 and 24 as they approach end 28 as best seen in FIG. 5. The end 28 is shown having a tapered or sharp edge 25 with a generally V-shaped notch 32 at an intermediate location. Thus, edge 25 being sharpened may be used for such operations as chopping. The notch 32 will assist the user in the removal of fasteners such as nails.

The head 16 is slightly arcuate along its lower or base surface 34. The end 26 is upwardly formed having a face 40 which can serve as a hammer surface. The surface 40 is rearwardly bent at its upper end to form a 90° flange 44 which both serves to strengthen the hammer surface 40 and to minimize interference when performing hammering or pounding operations.

The shaft 12 is attached to the head at an intermediate location to the upper surface of the head by suitable adjoining technique such as welding. To reinforce the connection between the shaft and the head, a pair of gusset plates 50 and 52, which are generally triangular, extend from the side of the shaft to the upper surface of the head.

Figure 3:
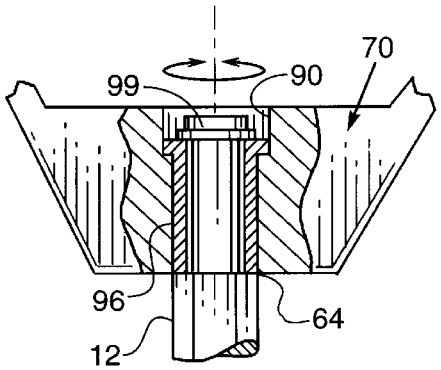
FIG. 3 is a sectional view taken along line 3—3 of FIG. 1.
Figure 4:
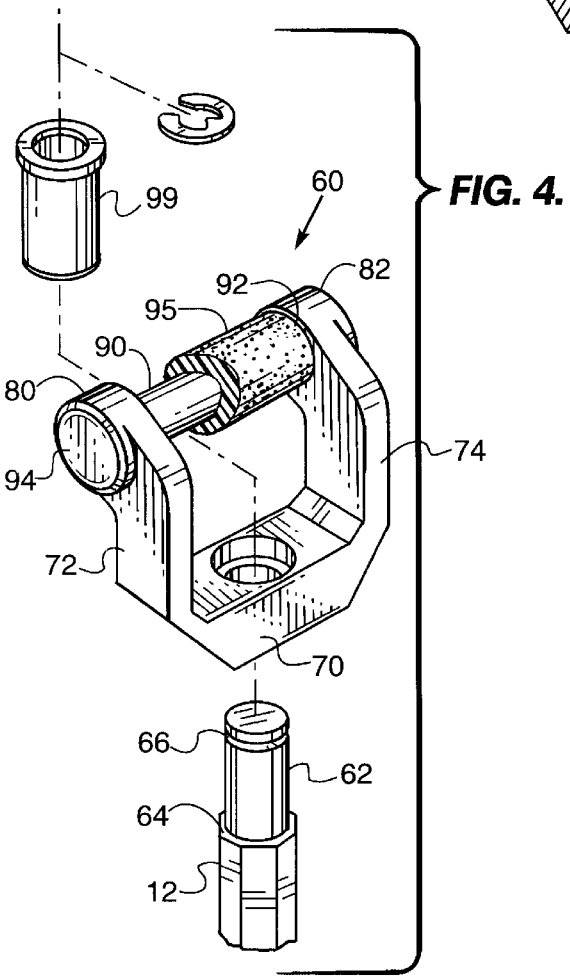
FIG. 4 is an exploded view of the upper end of the tool showing the details of the upper end of the shaft and handle.

The upper end of the shaft 12 carries a handle 60. As best seen in FIGS. 3 and 4, the upper end of the shaft is formed into a reduced diameter stub shaft section 62. A shoulder 64 is formed at the inner end of the stub shaft 62. The upper end of the stub shaft 62 is provided with an annularly extending groove 66. The handle assembly includes a body having a transverse body 70 and a pair of oppositely disposed, upwardly extending arms 72 and 74 which each have an upper end 80, 82, respectively, which extend at a generally obtuse angle with respect to arms 72 and 71 so as to provide an offset mounting location for pin 90. Pin 90 extends transversely between the upper arm ends 80, 82 and is received in bores 92 in the offset portion of the arms. Pin 90 may be of a suitable steel and is secured in place by flattened ends 94. A suitable resilient sleeve 95 extends around the pin for the comfort of the user. The sleeve and pin form a grip which is as indicated in FIG. 2 rotatable about all axis transverse to the slial.

As best seen in FIG. 3, the body 70 of the handle is provided with a stepped bore having a lower section 96 and a larger diameter upper recess section 98. The bore receives the reduced diameter stub shaft 62. The handle is retained on the shalt 12 by snap ring 99 engaged in groove 66. A sleeve 99, which may be steel or may be a low-friction bearing material, is interposed between the stub shaft and the bore in tile handle to facilitate rotation of the handle about the axis of the shaft 12.

Figure 1:
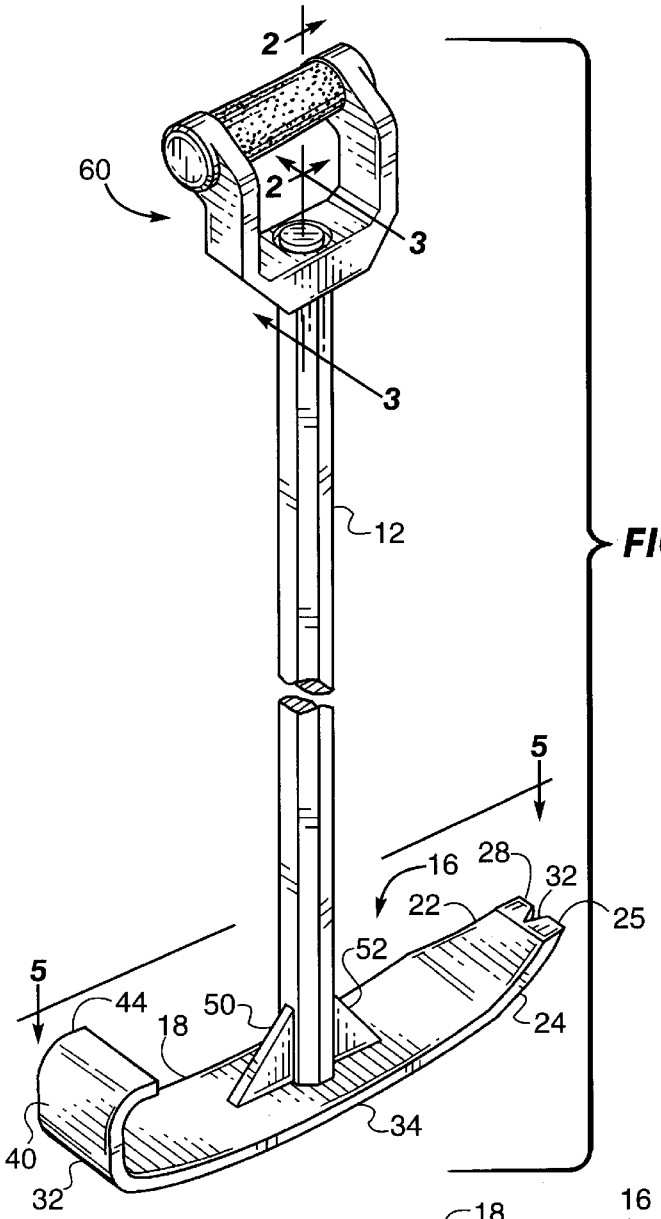
FIG. 1 is a perspective view of the multi-purpose construction tool of the present invention.
Figure 2:
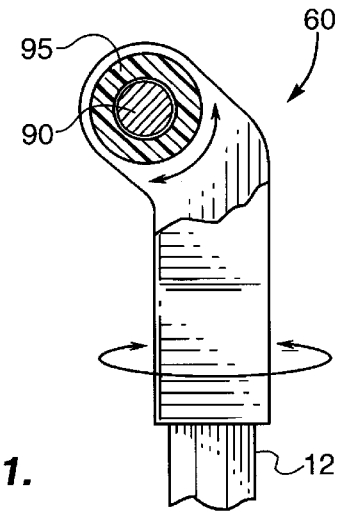
FIG. 2 is a sectional view taken along line 2—2 of FIG. 1.

As indicated above, the handle is rotatable about the longitudinal axis of the shaft 12 and the grip is rotatable in a transverse direction as shown in FIG. 2. The bi-directional rotation of the handle facilitates use of the tool.

In use, the device is a multi-purpose tool which call be used by construction and demolition personnel. The tool can be gripped at the handle and the flattened outer surface of the head can be used as a basher for demolishing wallboard and the like. The end 28 can be used as a ply bar and the notch 32 is for removal of fasteners. The sharpend edge 25 can be used as a pick ax and can also be used to facilitate insertion of the tool between members such as boards when prying.

The opposite face 40 may be used as a hammer for pounding or for demolition. In addition to hammering the tool may also be used as a sledge hammer, particularly the embodiment in which shaft 12 is elongated.

Figure 8:
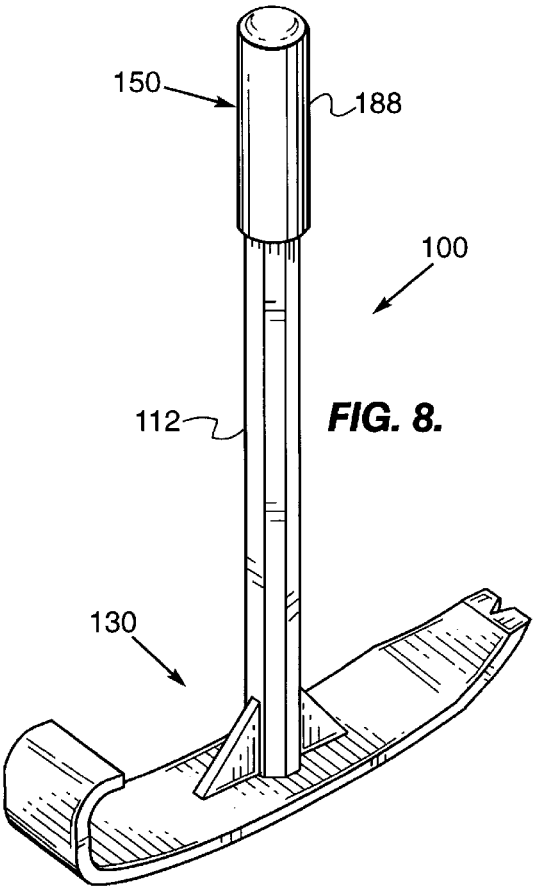
FIG. 8 is a perspective view of an alternate embodiment of the multi-purpose tool of the present invention.

FIG. 8 shows an alternate embodiment of the present invention which is generally designated by the numeral 100. Embodiment 100 is fabricated with a head 130 having an extending shaft 112 which head and shaft are substantially similar to the shaft and head described with respect to FIGS. 1 to 7. The principle modification of this embodiment is that the upper end of the handle 112 has an axially extending grip 150 which is covered with a resilient cushioning member or sleeve 188.

In other respects, the construction, use and function of the tool shown in FIG. 8 is as has been previously described.

From the foregoing, it will be seen that the present invention provides a highly unique and versatile multi-purpose tool which may be used as a crow bar, pry bar, sledge, pick ax, wedge and the like and has utility for construction workers, demolition personnel as well as for general use.

It will be obvious to those skilled in the art to make various modifications, changes and alterations. To the extent such modifications, changes and alterations do not depart from the spirit and scope of the appended claims, they are intended to be encompassed therein.

I claim:

1. A manual multi-purpose wrecking tool comprising:

(a) an elongate shaft having an upper and a lower end;

(b) a head secured transversely at lower end, said head having opposite first and second ends, opposite sides and a top and bottom, said top and bottom being arcuate;

(c) said sides converging in toward said first end, said first end defining a sharpened edge;

(d) said second end being integrally formed with a hammer surface extending generally parallel to said shaft, said hammer surface having an upper edge with a flange extending therefrom toward said shaft;

(e) a handle at the upper end of said shaft, said handle having a body rotative with respect to said shaft, said body having spaced-apart arms each with an offset section; and (f) a grip rotatively extending between said offset sections.

2. The manual multi-purpose wrecking tool of claim 1 wherein said sharpened edge is notched.

3. The manual multi-purpose wrecking tool of claim 1 wherein said grip includes a resilient covering.

4. The multi-purpose tool of claim 1 wherein said head and handle are fabricated from high strength steel.

5. The multi-purpose tool of claim 1 wherein said handle and head are forged construction.

6. The multi-purpose tool of claim 1 wherein said handle is disposed about a sleeve on said shaft and is secured by a snap ring engageable with said shaft.

* * * * *